US007694461B2

(12) United States Patent
Marocco

(10) Patent No.: US 7,694,461 B2
(45) Date of Patent: Apr. 13, 2010

(54) SHUTTER ASSEMBLY WITH LATCH MECHANISM AND CATCH PLATE

(76) Inventor: Mario M Marocco, 240 Bartor Road, Toronto, Ontario (CA) M9M 2W6

( * ) Notice: Subject to any disclaimer, the term of this patent is extended or adjusted under 35 U.S.C. 154(b) by 45 days.

(21) Appl. No.: 12/155,454

(22) Filed: Jun. 4, 2008

(65) Prior Publication Data

US 2009/0300990 A1 Dec. 10, 2009

(51) Int. Cl.
*E05C 17/00* (2006.01)

(52) U.S. Cl. ..... 49/394; 49/74.1; 292/23; 292/252

(58) Field of Classification Search ..... 49/74.1, 49/394; 292/9, 23, 252, 288, DIG. 15
See application file for complete search history.

(56) References Cited

U.S. PATENT DOCUMENTS 263,276 A * 8/1882 Wood ..... 49/211
948,598 A * 2/1910 Stuart ..... 292/73
2,070,149 A * 2/1937 Turner ..... 292/252
2,621,954 A * 12/1952 Buck ..... 292/252
3,045,663 A * 7/1962 McDonnold ..... 126/190
3,527,486 A * 9/1970 Anton ..... 403/11
3,674,297 A * 7/1972 Hawkins ..... 292/252
4,314,719 A * 2/1982 Hawkins ..... 292/252
4,772,054 A * 9/1988 Schreiber et al. ..... 292/275
5,303,507 A * 4/1994 Oille ..... 49/74.1
5,653,057 A * 8/1997 Gary ..... 49/67
5,765,883 A * 6/1998 Dessenberger et al. ..... 292/92
5,884,947 A * 3/1999 Lopez et al. ..... 292/198
6,312,026 B1 * 11/2001 Workman ..... 292/252
6,601,353 B2 * 8/2003 Gabriele ..... 52/202
6,865,846 B2 * 3/2005 Hsu ..... 49/74.1

* cited by examiner

*Primary Examiner*—Jerry Redman

(57) ABSTRACT

A shutter assembly for mounting in a building fabric or window opening and having a rectangular frame and a latch mechanism and a catch plate to allow locking and unlocking of the shutter assembly in the window, in which the catch plate has a transverse groove receiving the latch mechanism, and a stop wall at a rearward end and a ramp at the forward end, and retaining pins for securing the catch plate in the window, all formed in one piece integrally.

1 Claim, 2 Drawing Sheets

SHUTTER ASSEMBLY WITH LATCH MECHANISM AND CATCH PLATE

FIELD OF THE INVENTION

The present invention relates to the field of shutters with louvres for windows and doorways. More particularly, the present invention relates to a shutter assembly which has a catch plate for a latch mechanism that hold the shutter assembly in a closed position when the shutter assembly is swung into a window or a doorway.

BACKGROUND OF THE INVENTION

A shutter assembly comprises a rectangular frame, consisting of a pair of vertically opposed side rails and a pair of horizontally opposed side rails, and a plurality of vertically spaced horizontal louvres. When a shutter assembly is not in use, it is swung on hinges around its vertical axis to an open position away from a window or a doorway to give free access to them. When a shutter assembly is in use, the shutter assembly is swung around its vertical axis to a closed position in a window or a doorway. There is a need for a mechanism that holds a shutter assembly in a closed position when the shutter assembly is swung into a window or a doorway. This need may be addressed by providing a latch mechanism incorporated into the vertically opposed side rails of the shutter assembly frame and a catch plate located on at least one of the upper and lower window-sills. When the latch mechanism locks in the catch plate, the shutter assembly is held in a closed position. When the shutter assembly is swung open, the latch mechanism is released from the catch plate and the shutter assembly can be swung around its vertical axis to an open position. Such a latch mechanism and a catch plate for a shutter assembly should have a clean, uncluttered appearance and should be a mechanism that is relatively simple to construct.

BRIEF SUMMARY OF THE INVENTION

The present invention provides a shutter assembly, consisting of a pair of vertically opposed side rails and a pair of horizontally opposed side rails with at least one latch mechanism and at least one catch plate. When the latch mechanism and the catch plate are locked together, they hold the shutter assembly in a closed position in a window. Preferably, the catch plate is adapted to be attached to a window frame or building fabric. Preferably, the lower side of the catch plate has at least two integral fastening pins that keep the catch plate fastened in position on a building fabric. Usefully, the catch plate has a stop wall that is perpendicular to the plane of the catch plate.

Usefully, the upper side of the catch plate has a receiving groove which receives and releases a spring-loaded stud of the latch mechanism.

To lock the shutter assembly in the window frame, the shutter assembly is swung around its vertical axis until the latch mechanism reaches the catch plate. The catch plate forces the spring loaded stud of the latch to retract and then snap in into the receiving groove of the catch plate. The catch plate stop wall functions as a positive stop to prevent the shutter assembly from swinging too far through the window frame.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

Figure 2:
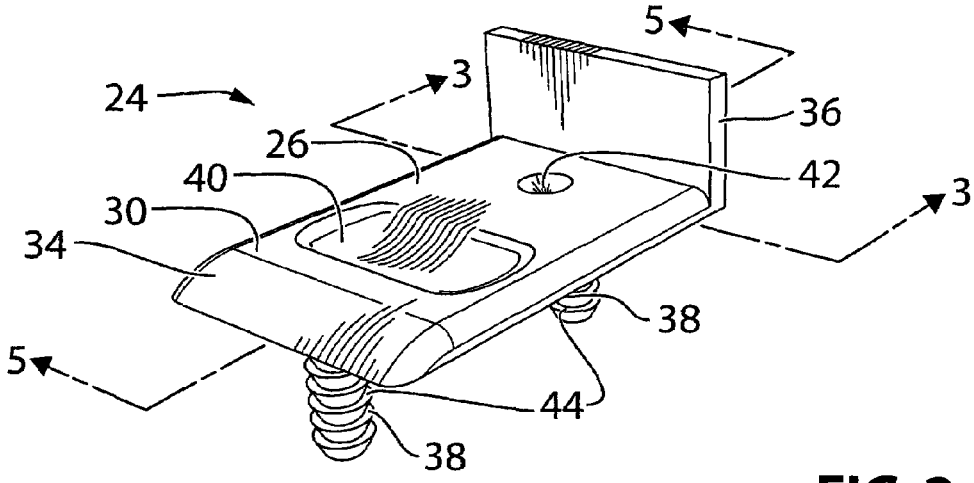
FIG. 2 is a perspective of the catch plate FIG. 1.
Figure 4:
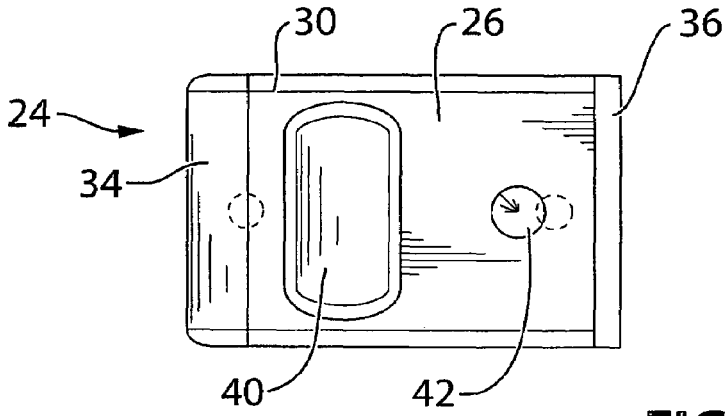
Figure 3:
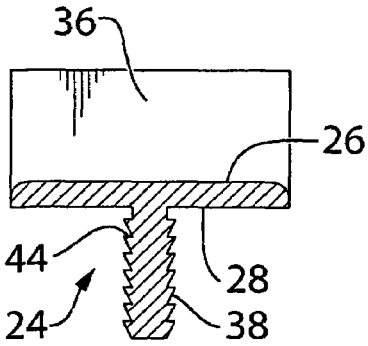
Figure 5:
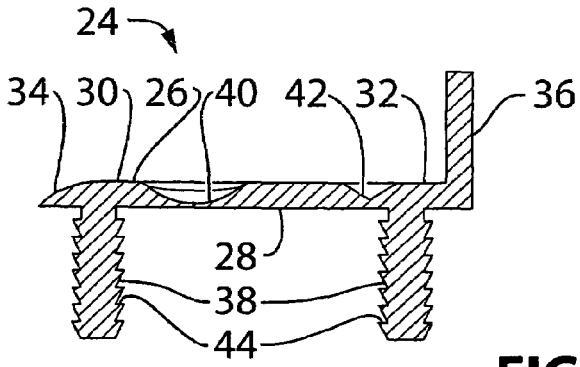

FIG. 3 a cross section of a catch plate shown on FIG. 2 along line 3-3;

FIG. 4 is a plan of a catch plate; and,

FIG. 5 is a cross section of the catch plate shown in FIG. 2 along line 5-5.

DESCRIPTION OF A SPECIFIC EMBODIMENT

Figure 1:
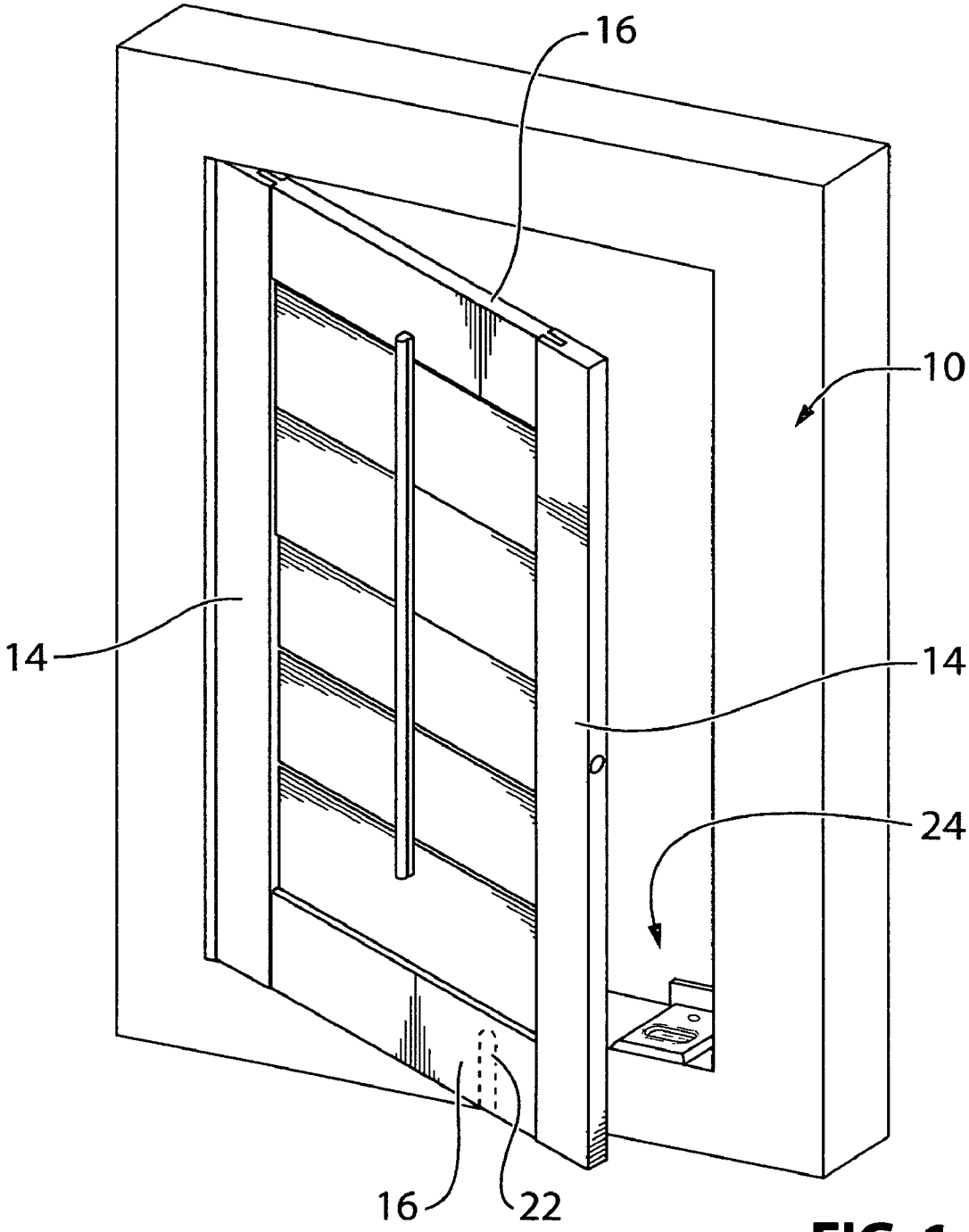
FIG. 1 is a perspective of a shutter assembly in a window frame.

In FIG. 1 a shutter assembly (10) illustrating an embodiment of invention, is shown installed in a window frame (12). Although the description which follows discloses the assembly as installed in a window frame (12), it should be understood that the shutter assembly (10) with minor modifications can be installed in a doorway, closet, partition, or interior hatchway.

The shutter assembly (10) has a rectangular frame comprised of a pair of vertically opposed side rails (14) and a pair of horizontally opposed side rails (16), as shown on FIG. 1.

The shutter assembly is mounted on hinges (not shown) connected between the shutter assembly and the window frame, and swings around its vertical axis between an open position and closed position. When the shutter assembly (10) is in an open position, shutter assembly (10) is swung away from the window frame (12). When shutter assembly (10) is in a closed position, the shutter assembly (10) is swung into the window frame (12).

The shutter assembly (10) has a latch mechanism (22) which co-operates with a catch plate (24) to hold the shutter assembly (10) in a closed position when it is swung in the window frame (12).

The Latch Mechanism

The latch mechanism (22) has a spring loaded stud (not shown), which engages the catch plate (24). The design of such latch mechanism is generally well known and requires no further description.

The Catch Plate

The catch plate (24) is shown in FIGS. 2 to 5. Preferably it is moulded from suitable thermoplastic material, known per se.

The catch plate (24) has a rectangular shape with an upper surface (26) and lower surface (28). The catch plate (24) has a receiving end (30) forwardly, and a rearward end (32).

The receiving end (30) of the catch plate (24) has a sloping rounded ramp (34). The back end (32) of the catch plate (24) has a stop wall (36), moulded integrally. The lower surface (28) of the catch plate (24) has two fastening pins (38). Pins (38) are molded integrally with catch plate (24), and have friction formations (44) thereon.

The fastening pins (38) are adapted to be inserted in two holes drilled in the window frame (12) and thus keep the catch plate (24) fastened in position.

The upper surface (26) of the catch plate (24) has a receiving groove (40). The receiving groove (40) is indented and has a generally semi-cylindrical concave shape to accommodate a typical spring loaded stud (not shown) of the latch mechanism (22). The receiving groove (40) extends transversely from side to side from close to one edge to close to the other edge of upper surface (26) so as to provide some latitude to accommodate misalignment of the shutter assembly (10) when the latch mechanism (22) is locked in the catch plate (24).

Additional security is provided by screw guide recess (42), which is located offset from pins (38).

Any suitable screw can be inserted into recess (42), and screwed into the window frame In the current embodiment there are two such catch plates, and upper and a lower catch plate. The upper catch plate would be located on the upper frame of the window (12).

The lower catch plate would be located on the lower frame of the window (12).

There would also be two latch mechanisms.

Function

The present invention is applicable to holding a shutter assembly in place by a latch mechanism (22) and a catch plate (24). In this way its possible to either lock the shutter assembly (10) in place when the shutter assembly (10) is swung into the window (12), or to unlock the shutter assembly (10) and swing it around its vertical axis away from the window (12) to give a free access to the window (12).

To lock the shutter (10) closed in the window frame (12), the shutter assembly (10) is swung around its vertical axis towards the window (12). The spring loaded stud reaches the sloping rounded ramp (34) of the receiving end (30) of the catch plate (24).

This forces the spring loaded stud to retract and thus slide over the upper surface (26) of the catch plate (24) until the spring loaded stud reaches the receiving groove (40) of the catch plate (24). The shutter assembly (10) thus becomes locked in the window (12).

To unlock the latch mechanism (22), the shutter assembly (10) is swung around its vertical axis away from the window (12).

The above is a description of a preferred embodiment of the invention which is given here by way of example only. The invention is not to be taken as limited to any of the specific features as described, but comprehends all such variations thereof as come within the scope of the appended claims.

What is claimed:

1. A shutter assembly adapted to be installed in a window frame, and comprising;

a shutter frame having a pair of vertically opposed side rails and a pair of horizontally opposed side rails;

at least one integral one piece thermoplastic moulded catch plate mountable on and said window frame, said catch plate formed of thermoplastic material and defining a generally rectangular shape in plan having an upper side and an under side and a receiving end and a rearward end;

at least one releasable latch mechanism in the shutter assembly for locking said shutter assembly in said catch plate;

a receiving groove moulded integrally in said catch plate for engaging said releasable latch mechanism, said receiving groove defining a generally semi-cylindrical profile in section, and extending transversely of said catch plate;

two fastening pins of thermoplastic material moulded integrally on the under side of said catch plate for fastening said catch plate on said window frame;

friction formations moulded integrally on said fastening pins for engaging said window frame;

a screw guide recess moulded integrally in said catch plate, for receiving a fastening screw therein:

a ramp surface moulded integrally on said upper side of said catch plate at said receiving end thereof, and, a stop wall moulded integrally with said catch plate at said rearward end thereof and extending upwardly from said upper side.

* * * * *